United States Patent [19]

Chirash et al.

[11] Patent Number: 4,772,425

[45] Date of Patent: Sep. 20, 1988

[54] LIGHT DUTY LIQUID DISHWASHING COMPOSITION CONTAINING ABRASIVE

[75] Inventors: William Chirash, New Providence; Harold E. Crosier, Madison; Christopher R. Proulx, Piscataway, all of N.J.

[73] Assignee: Colgate-Palmolive Company, New York, N.Y.

[21] Appl. No.: 812,874

[22] Filed: Dec. 23, 1985

[51] Int. Cl.[4] ..... C11D 1/90; C11D 3/14; C11D 11/00

[52] U.S. Cl. ..... 252/547; 252/154; 252/155; 252/173; 252/174.25; 252/546; 252/548; 252/550; 252/551; 252/553; 252/554; 252/555; 252/558; 252/DIG. 14

[58] Field of Search ..... 252/173, 154, 174.25, 252/547, 548, 140, 155, 546, 551, 550, 558, DIG. 14, 163

[56] References Cited

U.S. PATENT DOCUMENTS

| | | | |
|---|---|---|---|
| 4,051,056 | 9/1977 | Hartman | 252/99 |
| 4,071,463 | 1/1978 | Steinhauer | 252/103 |
| 4,161,566 | 7/1979 | Higgins | 428/454 |
| 4,457,856 | 7/1984 | Mitchell et al. | 252/166 |
| 4,554,098 | 11/1985 | Klisch et al. | 252/547 |
| 4,555,360 | 11/1985 | Bissett et al. | 252/541 |

FOREIGN PATENT DOCUMENTS

| | | |
|---|---|---|
| 1143240 | 3/1983 | Canada . |
| 38299 | 3/1984 | Japan . |
| 215399 | 12/1984 | Japan . |
| 6797 | 1/1985 | Japan . |
| 76598 | 5/1985 | Japan . |
| 139793 | 7/1985 | Japan . |
| 2140451A | of 1984 | United Kingdom . |
| 2145729A | 3/1985 | United Kingdom . |
| 2153838A | 8/1985 | United Kingdom . |
| 2168377A | 6/1986 | United Kingdom . |

*Primary Examiner*—Prince E. Willis

*Attorney, Agent, or Firm*—Richard J. Ancel; Marta Delsignore; Richard N. Miller

[57] ABSTRACT

A stable, high foaming, light duty liquid abrasive-containing dishwashing composition containing about 3% to 15% by weight of a water insoluble, particulate, low density abrasive suspended in an aqueous vehicle comprising at least one water-soluble, anionic sulfated or sulfonated detergent salt containing an alkyl group or alkenyl group having from 8 to 20 carbon atoms in the molecule, a betaine foam booster, about 1-3% by weight of a substantially completely hydrated colloidal clay as a stabilizing agent and, optionally, about 2% to 9% of a $C_2$-$C_3$ alcohol is disclosed. The presence of the abrasive greatly improves the cleaning efficacy in removing baked-on and/or dried-on food residues without significant scratching when used full strength. Also, within the scope of the invention is a method of making liquid, abrasive-containing, dishwashing compositions which have improved stability against separation and are of low viscosity which comprises the steps of preparing a presheared clay/water mixture to substantially fully hydrate the clay suspending agent and adding said mixture to the remainder of the composition as the last ingredient with agitation sufficient to disperse the clay suspension without aeration of the resultant mixture and continuing such agitation while monitoring viscosity until a consistent minimum viscosity is attained after an initial increase to a viscosity maximum.

15 Claims, No Drawings

LIGHT DUTY LIQUID DISHWASHING COMPOSITION CONTAINING ABRASIVE

BACKGROUND OF THE INVENTION

The present invention relates to the formulation of a stable, high foaming light duty liquid dishwashing composition containing a minor amount of water-insoluble, particulate, low density abrasive suspended in an aqueous vehicle comprising an anionic surfactant system in combination with a betaine foam booster, a colloidal clay stabilizing agent, said clay being in the form of a presheared clay/water mix which is added as the final ingredient in the manufacture of said composition.

Liquid hard surface cleaning compositions have generally been classified into two types. The first type relates to aqueous suspensions of water-insoluble, abrasive particles suspended in an aqueous medium containing surfactants. Many of the compositions of this type suffer a stability problem. The second type relates to liquid detergents intended for general cleaning purposes which do not require an abrasive and these detergents are further subdivided into all-purpose liquid detergents containing inorganic and/or organic builder salts and into all-purpose light duty liquid detergents containing no builders.

The stability problem suffered by all-purpose liquid abrasive detergent compositions is clearly shown in U.S. Pat. No. 4,240,919, wherein a water-insoluble stearate salt (magnesium stearate) is added to an aqueous medium containing a detergent to provide stability and to prevent syneresis of the abrasive-containing compositions upon standing. The compositions in this patent disclose use of any compatible surfactant including anionic, nonionic, amphoteric, cationic or zwitterionic surfactants to aid in the cleaning of the hard surface by the abrasive ingredient.

Also, disclosed in the prior art is the use of inorganic and/or organic abrasives in built (heavy duty) liquid detergent compositions containing an anionic-nonionic surfactant system as disclosed in Canadian Pat. No. 1,143,240, European Patent Publication No. 0,030,986, and U.S. Pat. No. 4,302,347. Additionally, European Patent Application No. 0,021,545 discloses the use of inorganic and/or heavy duty liquid detergent compositions containing an anionic-nonionic surfactant system.

Light duty liquid detergent compositions of the second type (no abrasive) containing an anionic-betaine-cationic surfactant system are disclosed in U.S. Pat. No. 3,980,769. Compositions containing a combination of two anionic sulfonate surfactants—an anionic sulfate, and an alkyl ethoxylate sulfate—and a zwitterionic betaine surfactant are disclosed in U.S. Pat. No. 3,332,877. Compositions containing an anionic-betaine surfactant system are disclosed in British Pat. No. 1,452,708. A two-phase liquid detergent composition comprising an oil layer and an aqueous layer containing a foaming non-cationic surfactant and, optionally, a suds improver such as a tertiary amine oxide, a betaine or a fatty acid alkanolamide is disclosed in U.S. Pat. No. 3,533,955.

However, none of the above-mentioned patents disclose a stable, high-foaming, light duty dishwashing liquid containing a minor amount of a low density abrasive suspended in an aqueous vehicle containing a surfactant system comprising at least one water-soluble, anionic sulfated or sulfonated detergent salt containing an alkyl group or an alkenyl group having from 8 to 20 carbon atoms in the molecules, e.g., an alkyl benzene sulfonate, an alkyl ethenoxy ether sulfate, etc., and a betaine, about 1–3% by weight of colloidal clay stabilizing agent, and a minor amount of a solublizer such as ethanol as a preferred optional ingredient.

SUMMARY OF THE INVENTION

This invention relates to light duty liquid detergent compositions, particularly dishwashing compositions, that combine the functions of both types of liquid hard surface cleaning compositions discussed above in order to give improved cleaning in difficult soil removal situations, i.e., effectively removes baked-on and/or dried-on food residues, It has now been found that a stable and dispersible, high-foaming, dishwashing liquid containing abrasive can be prepared with a surfactant system comprising at least one water-soluble, anionic, sulfated or sulfonated detergent salt containing an alkyl group or an alkenyl group having from 8 to 20 carbon atoms in the molecule, e.g., an alkyl benzene sulfonate, an alkyl ethenoxy ether sulfate, etc., and betaine by the addition of about 1–3% by weight of a colloidal clay in the form of a presheared clay-water mix to the aqueous abrasive-surfactant-containing composition with continuous mixing. Dispersibility is enhanced in preferred compositions by the addition of a minor amount (2%–9% by weight) of ethanol. Dispersibility as used herein refers to how quickly or easily the formulation, except for the abrasive, is dissolved in the wash water. This composition has significantly improved cleaning efficiency. It permits easier cleaning of baked-on/dried-on food residues on soiled baking dishes and pots and pans. When used neat, i.e., in undiluted form, it performs as a scouring composition and when diluted it performs as an ordinary dishwashing liquid in the dishpan since the insoluble abrasive will settle out and be discharged with the wash water. Thus, it lessens the consumer's need for scouring aids and special cleaners for difficult cleaning situations.

Accordingly, the primary object of the invention is to provide a novel light duty dishwashing liquid composition containing an abrasive which improves cleaning in tough soil situations such as baked-on/dried-on food residues.

Another object of this invention is to provide a novel liquid detergent product having good stability and high-sudsing characteristics comparable or superior to those of the current leading dishwashing liquid brands.

Still another object of this invention is to provide a readily dispersible, abrasive-containing, dishwashing, liquid composition in the wash water during use.

A further object of this invention is an improved method of making light duty liquid detergent compositions containing an abrasive and a colloidal clay stabilizing agent which comprises the steps of preparing a presheared clay/water mixture using high shear mixing to form a thixotropic clay/water mixture wherein the clay is substantially fully hydrated and adding said mixture of a particulate abrasive and an aqueous concentrate of a light duty liquid detergent composition containing at least one anionic sulfated or sulfonated detergent and a foam stabilizing component with slow agitation and continuing said agitation for up to 5 hours while monitoring viscosity until a substantially consistent minimum viscosity is achieved after a period during which the viscosity often increases to a maximum.

To achieve the foregoing and other objects and in accordance with -the present invention, as embodied and broadly described herein, the novel stable, high foaming light duty liquid dishwashing composition of this invention comprises about 3–15% by weight of a water-insoluble, particulate, low density abrasive having a particle size within the range of 8 microns to 595 microns suspended in an aqueous vehicle containing 8% to 50% by weight of a water soluble surfactant system comprising at least one anionic sulfated or sulfonated detergent salt containing an alkyl group or an alkenyl group of 8 to 20 carbon atoms in its molecular structure and a zwitterionic betaine foam stabilizer, about 1–3% by weight of a colloidal clay and, preferably, a minor amount of $C_2$–$C_3$ alcohol, said composition having a pH in the range of 7 to 10, preferably 7 to 8.5 and most preferably 7 to 7.6.

More specifically, the present invention relates to stable, high foaming and dispersible light duty liquid dishwashing compositions comprising at least about 5% by weight of a water-insoluble, low density abrasive having a particle size of 8 to 595 microns suspended in an aqueous vehicle containing about 20%–40% by weight of a water soluble ternary surfactant system of a $C_8$–$C_{18}$ alkyl benzyl sulfonate or a $C_{10}$–$C_{20}$ alkane sulfonate a $C_8$–$C_{18}$ alkyl ethenoxy ether sulfate and a betaine, 1.2% to 2% of said clay in the form of a presheared clay/water mix, and about 2% to 9% ethanol.

The compositions can be formulated to exhibit a high degree of stability upon storage at normal room temperature of about 21° C. over a period of many months without any precipitation or formation of layers. When subjected to elevated temperatures of about 30° C. or cooled to about 4° C. the compositions may remain stable. As a result of this stability, even when only very small quantities are dispensed, the components will be present in the correct proportions. The compositions may be packaged in any suitable containers such as metal, plastic or glass bottles, plastic bags, cans or drums and are easy to dispense therefrom.

The present invention also includes the process of making stable, abrasive-containing liquid compositions comprising the steps of (1) preparing an aqueous clay suspension using high shear mixing to form a thixotropic clay-water mixture wherein the clay is substantially fully hydrated; (2) preparing an aqueous detergent concentrate containing at least one anionic sulfated or sulfonated detergent and a foam boosting ingredient selected from the group consisting of a zwitterionic betaine surfactant, a trialkyl amine oxide detergent containing a $C_{10}$–$C_{16}$ alkyl group and a $C_8$–$C_{18}$ alkanoic acid $C_2$–$C_3$ alkanolamide and the balance of water; (3) dispersing a porous, low-density, particulate abrasive selected from the group consisting of calcine diatomaceous earth and particulate polymeric plastic materials having a specific gravity of from 0.75 to 1.5 in said aqueous detergent mixture with slow agitation; (4) continuing said slow agitation until a substantially deaerated dispersion is obtained; (5) adding the substantially fully hydrated clay suspension to the deaerated dispersion of step 4 with agitation at a speed sufficient to disperse the clay suspension without aeration of the resultant mixture; and (6) continuing said agitation while monitoring the viscosity until a substantially consistent minimum viscosity is obtained after an initial increase to a viscosity maximum. The foregoing process is suitable for making the low-viscosity, abrasive-containing dishwashing liquid of improved stability against separation containing a water-soluble, sulfated or sulfonated anionic detergent in combination with a zwitterionic betaine or a trialkyl amine oxide or a $C_8$–$C_{18}$ alkanoic acid $C_2$–$C_3$ alkanolamide foam booster. Thus, the inventive process is suitable for making the inventive compositions disclosed herein as well as related abrasive-containing, liquid dishwashing compositions.

DETAILED DESCRIPTION OF THE INVENTION

The particulate abrasives which are suitable for use in the abrasive-containing liquid detergent compositions may be described as porous, low density, water-insoluble abrasives. Satisfactory abrasives include calcined diatomaceous earth and plastics, e.g., polystyrene, polyacrylates. Such materials are intermediate in abrasivity according to the Mohs hardness scale, i.e., having an abrasivity of less than about 7.0, and, thus, exhibit minor scratching. Because the abrasivity of the described abrasives also is related to the particle size of the abrasive, the concentration of abrasive present must be integrated with its particle size in order to achieve the desired cleaning efficacy. Since a small particle size is less effective in viscous liquids, it is desirable to use abrasives having a broad range of particle sizes. Generally, the particle size of the abrasive will be from about 8 microns to 595 microns, with a relatively high concentration, e.g., 20% to 45% by weight, of particles larger than 44 microns. These abrasives are relatively easy to suspend stably in the dishwashing liquid composition.

Calcined diatomaceous earth is a preferred abrasive and is composed of siliceous skeletons of microscopic plants known as diatoms. Diatomite is available in relatively pure form, with the difference in purity being reflected in the color. In relatively pure form, the material is white, friable, porous and chalklike. In impure form, the color may be cream, tan, gray, brown, or green. It specific gravity may vary from 1.9–2.35 with the preferred material having a specific gravity of about 2.2 to 2.3, but the apparent density of the powder will be 5 lbs. to 16 lbs. per cubic foot. Diatomite absorbs 1–4 times its weight of water and has a Mohs hardness in calcined form of about 1–6. Diatomite is essentially silica ($SiO_2$) with varying amounts of impurities which vary in turn with conditions of sedimentation at the time of diatom deposition. Preferred diatomaceous earths may be purchased under tradenames Celite 560 and Hyflo Super Cel. These diatomaceous earths are calcined in a high temperature process, e.g., above 1500° C., in order to increase their particle size. The starting particle size range of about 8 to 100 microns increases due to agglomeration during calcining to produce a typical range of about 10% larger than 149 microns, about 12% is less than 149 microns and larger than 74 microns, about 15% is less than 74 microns and larger than 44 microns and the balance is less than 44 microns, said proportions being by weight. Calcining is essential to produce the desired range of particle sizes in which from 20%–45% by weight of the particles are larger than 44 microns, with a minimum of about 5%–15% by weight of particles being larger than 149 microns.

Other suitable abrasives are the particulate or powdered, organic, polymeric, plastic materials such as powdered polystyrene powdered methyl methacrylate, powdered polyethylene, powdered polypropylene, powdered copolymers such as alpha methyl styrene-styrene-acrylonitrile, acrylonitrile-butadiene-styrene, diallyl phthalates, melamines and isocyanurates. Generally, these materials have a particles size of from about 8 to 250 microns, preferably from 45 to 150 microns, and a specific gravity of from 0.75 to 1.5, preferably 0.95 to 1.05. Also, these materials have a Rockwell R hardness of 50 to 130 or a Mohs hardness of 1 to 3. Such abrasives form stable suspensions and, in use, provide desired cleaning without significant scratching.

Another essential ingredient in the abrasive-containing, liquid dishwashing composition is a colloid-foaming, expandable clay which functions both as a thickening agent for the formula and as a suspending agent for the abrasive. These expandable clays are those classified geologically as smectites and attapulgites.

Suitable smectite clays are the montmorillonite clays which are primarily hydrated aluminosilicates and the hectorites which are primarily hydrated magnesium silicates. It should be understood that the proportion of water of hydration in the smectite clays varies with the manner in which the clay has been processed. However, the amount of water present is not significant because the expandable characteristics of the hydrated smectite clays are dictated by the silicate lattice structure. Additionally, deficit charges in smectite are compensated by cations such as sodium, calcium, potassium, etc., which are sorbed between the three layer (two tetrahedral and one octahedral) clay mineral sandwiches.

The smectite clays used in the liquid compositions are commercially available under various trade names such as Thixogel No. 1 and Gelwhite GP from Georgia Kaolin Company (both montmorillonites) and Veegum Pro and Veegum F from R. T. Vanderbilt (both hectorites). A preferred clay is Gelwhite GP which is a colloidal montmorillonite clay of a high viscosity sold by Georgia Kaolin company. This clay contains about 6% to 10% by weight of water and is a mixture of the following oxides: 59% $SIO_2$, 21% $Al_3O_3$, 1% $Fe_2O_3$, 2.4% CaO, 3.8% MgO, 4.1% $Na_2O$ and 0.4% $K_2O$. 100% by weight of the clay passes through a 200 mesh screen. It disperses readily in water, but requires maximum swelling in water before use. This swelling of the clay is important to eliminate liquid layering. During this swelling process, the clay/water mix builds substantial viscosity. It is also thixotropic and, therefore, exhibits a yield point as well. 350 dynes/$cm_2$ has been judged to be a preferred yield point for a clay/water mix of Gelwhite GP because at this point the other physical properties of the final composition, e.g., pourability, dispersibility, suspending ability and liquid layering,are acceptable. (The term "layering" refers to the amount—in millimeters—of clear liquid visible on the surface of the finished formula after aging at 49° C. for one week and for ten weeks.) A clay/water mix having a yield point of 350 dynes/$cm^2$ is acceptable regardless of Gelwhite GP concentration. The yield point normally is measured using HAAKE rv12, MVIP, E=0.3, R=100 O=113 min, 18 minute hold, grooved rotor and cup.

Another expandable clay material suitable for use in the liquid compositions is classified geologically as attapulgite, a magnesium rich clay. A typical attapulgite analysis yields 55.02% $SiO_2$; 10.24% $Al_2O_3$; 3.53% $Fe_2O_3$; 10.49% MgO; 0.47% $K_2O$; 9.73% $H_2O$ removed at 150° C. and 10.13% $H_2O$ removed at higher temperatures. These clays have a small particle size, with 100% of the clay passing through a 200 mesh screen. Attapulgite clays are commercially available under various trade names such as Attagel 40, Attagel 50 and Attagel 150 from Engelhard Minerals & Chemicals Corporation. Of course, mixtures of smectite clays and attapulgite clays are suitable, too, to provide combinative properties which are not obtained from either class of clay above.

In order to achieve the desired swelling, a suspension of clay in water is subjected to high-shear mixing for a sufficient time to substantially fully hydrate the clay before its introduction into the organic portion of the formulation. For example, the desired swelling can be accomplished by high speed shearing of an 8% aqueous clay dispersion for 25 minutes. When the clay is substantially fully hydrated, the viscosity of the aqueous suspension increases dramatically and, thus, the swelling process permits the use of lower concentrations of clay. For example, concentrations of clay as low as 1% to 1.55% and up to a maximum of 3%, preferably 1.2% to 2%, by weight are effective to stabilize the inventive abrasive composition without adversely affecting its dispersibility in water. As indicated above, the clay/water mix used in the described composition preferably has a yield point of about 350 dynes/$cm^2$, but satisfactory abrasive compositions can be prepared with aqueous-clay dispersions having a yield point as low as 300 dynes/$cm^2$ and as high as 450 dynes/$cm^2$.

The foregoing water-insoluble, low-density, abrasives are suspended in the dishwashing liquid composition and their concentration ranges from 3% to 15%, preferably from 5% to 15%, by weight. If desired, small amounts, e.g., 1% to 25% by weight (based upon the total weight of abrasive in the composition), of crystalline abrasives having a Mohs hardness of 2 to 7 such as silica or calcium carbonate may be substituted for part of the low density abrasive provided that a substantially stable liquid dishwashing composition results.

The other essential components of the inventive liquid composition consist of a surfactant mixture comprising at least one water-soluble anionic detergent salt containing an alkyl group or an alkenyl group of 8 to 20 carbon atoms its molecular structure and a water soluble zwitterionic betaine surfactant as a foam stabilizer. Preferably, the surfactant mixture is a ternary mixture of either a water-soluble, alkali metal or ammonium salt of a $C_8$–$C_{16}$ alkyl benzene sulfonate (LAS) or a water-soluble salt of a $C_{10}$–$C_{20}$ alkane sulfonate with a water-soluble salt of a $C_8$–$C_{16}$ alkyl ethenoxy ether sulfate (AEOS) and the betaine surfactant foam booster. The total surfactant concentration generally constitutes about 8% to 50%, preferably 20% to 40% and most preferably 25% to 35% by weight of the liquid dishwashing composition, with the betaine component being about 2% to 5% by weight thereof. The concentration of the anionic detergents in the liquid dishwashing composition, can be determined by difference and ranges from 8% to 48%, preferably 18% to 38%, most preferably 23% to 33%, by weight of the liquid composition, with the ratio of alkyl benzene sulfonate or alkane sulfonate to alkyl ethenoxy ether sulfate in the preferred compositions being noncritical and in the range of 10:1 to 1:4, preferably from 4:1 to 1:1. A ratio of 1.3:1 of alkyl benzene sulfonate or $C_{10}$–$C_{20}$ alkane sulfonate to alkyl ethenoxy ether sulfate is particularly preferred at 34% concentration of the ternary mixture.

As indicated above, the anionic surfactant mixture which is used in the detergent composition of the invention includes at least one surfactant selected from the group consisting of a water-soluble salt, e.g., sodium, potassium, ammonium and $C_2$–$C_3$ alkanolammonium salts, of an anionic sulfated or sulfonated detergent containing an alkyl group or analkenyl group of 8 to 20 carbon atoms in its molecular structure. Suitable anionic sulfated or sulfonated detergents salts include the water soluble salts of $C_8$–$C_{16}$ alkyl benzene sulfonate, preferably a $C_9$–$C_{15}$ alkyl benzene sulfonate, such as sodium dodecyl benzene sulfonate, triethanolammonium tetradecyl benzene sulfonate, sodium pentdecyl benzene sulfonate and the like; water-soluble salts of a $C_{10}$–$C_{20}$ alkyl sulfonate, preferably $C_{13}$–$C_{17}$ alkyl sulfonate, such as sodium $C_{13}$–$C_{17}$ alkyl sulfonate; water soluble salts of a $C_{10}$–$C_{20}$ alkenyl sulfonate, preferably $C_{14}$–$C_{16}$ alkenyl sulfonate, such as sodium $C_{14}$–$C_{16}$ alkenyl sulfonate; a water soluble salt of alkyl ethenoxy ether sulfate having the general formula $R(OCH_2CH_2)_nOSO_3M$, wherein R is an alkyl radical of 8–16 carbon atoms, n is an integer having the value of 1–12, preferably 1–5, and M is an alkali metal, ammonium or $C_2$–$C_3$ alkylolammonium, such as sodium or ammonium lauryl triethenoxy ether sulfate, sodium and potassium salts of sulphuric acid esters of the reaction products of one mole of $C_8$–$C_{16}$ fatty alcohol and about 1–5 moles, preferably 3 moles, of ethylene oxide, ammonium $C_{12}$–$C_{15}$ alkyl triethenoxy ether sulfate and the like. The presence of the two anionic detergents such as a mixture of $C_9$–$C_{15}$ alkyl benzene sulfonate salt or $C_{13}$–$C_{17}$ alkyl sulfonate salt with a $C_8$–$C_{16}$ alkyl ethenoxy ether sulfate salt results in compositions which exhibit synergistically improved cleaning properties over the use of a single anionic detergent and, thus, such mixtures are preferred.

The water-soluble, zwitterionic betaine component of the instant liquid detergent composition has the general formula:

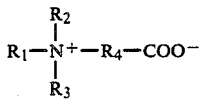

wherein $R_1$ is an alkyl group having 10 to 20 carbon atoms, preferably 12 to 16 carbon atoms or the amido radical;

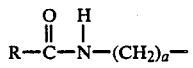

wherin RCO is an acyl group having about 10 to 20 carbon atoms and a is an integer from 1 to 4; $R_2$ and $R_3$ are each alkyl groups having 1 to 3 carbons and preferably 1 carbon; $R_4$ is a alkylene or a monohydroxyalkylene group having from 1 to 4 carbon atoms. Typical alkyldimethyl betaines include decyl dimethyl betaine or 2-(N-decyl—N, N-dimethylammonio) acetate, coco dimethyl betaine or 2-(N-dimethylammonio) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethyl dimethyl betaine, cocoamidopropyl dimethyl betaine, and the like. The presence of the betaine in the surfactant system, particularly in the ternary detergent system, provides an increase in the volume of the foam and an increase in the duration of the foam, as well as provides the compositions with mildness to the skin during use.

All of the aforesaid components in this light duty detergent are water soluble and remain water soluble during storage.

This particular combination of anionic surfactant and betaine provides a detergent system which co-acts with the presheared clay ingredient and the abrasive to produce a stable liquid detergent composition with desirable foaming, foam stability, detersive properties and superior baked-on food residue removal as well as desirable viscosity characteristics. Foaming is primarily a function of the surfactant content. However, the amount of suds is also affected by the dispersibility of the products. In fact, the speed with which they disperse during the foam generation stage is very important to the foam amount.

An optional ingredient in the inventive, liquid, dishwashing composition tions is a $C_2$–$C_3$ alcohol. This ingredient is present in the preferred compositions in a weight proportion of 2% to 9% by weight and the preferred alcohol is ethanol, although other alcohols such as isopropanol and propylene glycol are satisfactory.

The balance of the liquid dishwashing composition is primarily water and the proportion of water—or of aqueous alcohol solvent if present—ranges from 32% to 86%, preferably 43% to 72% and most preferably 48% to 68%, by weight.

Further, optional additives such as dyes, perfumes, humectants, e.g., sorbitol, polymers, e.g., polyacrylic polymer, and germicides also may be included in the composition in conventional individual amounts of up to about 2% by weight, with the total weight of additives usually not exceeding 5% by weight of the total composition.

In the manufacture of the inventive abrasive-containing, dishwashing liquid compositions, it is important to control the viscosity of the final dishwashing composition and to minimize aeration. More particularly, low viscosity aids in better dispersion of the product in water and satisfactory flow rates from the container, but the viscosity also must be high enough to maintain the abrasive in substantially stable suspension. On the other hand, the presence of trapped air—aeration—adversely affects dispersibility in water and stability against separation of the abrasive. Accordingly, it is essential to formulate a product with a low amount of aeration.

The viscosity and degree of aeration in the final product are dependent upon a number of factors which must be controlled and properly integrated in order to achieve a liquid dishwashing composition having good dispersibility and good stability. More particularly, it has been discovered that the clay must be substantially completely swelled in order to achieve good stability—minimal layering—and a low viscosity consistent with better dispersibility; and substantially complete swelling requires intensive shearing of the clay/water mixture for a sufficient period of time during the preparation of the clay dispersion and the preparation of the liquid dishwashing composition. Furthermore, once a completely swelled clay dispersion is achieved, it is noted that the viscosity and stability of the dishwashing composition vary with the concentration of clay present in the said composition. Also, the viscosity of the resultant composition varies with the time of agitation.

In the course of preparing the abrasive containing liquid dishwashing compositions, it was found that the complete formula usually undergoes a rapid rise in viscosity to a peak during the first hour of mixing and, thereafter, it declines over a period of time, e.g., several hours of mixing, to a substantially consistent minimum where it remains. Typically, a product containing 1.25% by weight of Glewhite GP clay climbs to about 9000 cps. in 39 minutes and declines to about 2,2000 cps. in about 4 hours at 500 rpm of agitation using a turbine agitator. Furthermore, after manufacture of the dishwashing composition is completed, the compositions increase in viscosity over the original stirred viscosity value with the passage of time to a substantially constant value. This process takes 500 hours or more at room temperature, e.g., 25° C. These effects are illustrated in the following Table A wherein the results of samples of final composition containing, by weight, 17% sodium dodecylbenzene sulfonate, 13% of ammonium $C_{12}$–$C_{15}$ alkyl triethenoxy ether sulfate, 4% cocoamidopropyl dimethyl betaine, 5.5% of ethanol and water are set forth. (Viscosity is measured by a Brookfield RVF viscometer using a heliopath TA spindle at 4 rpm.)

TABLE A

| Clay Concentration by weight(1) | Viscosity (cps)(2) | Viscosity after (3)Standing (cps.) | Layering (mm.)(4) |
|---|---|---|---|
| 1.5 | 3000 | 12000 | 0 |
| 1.5 | 15000 | 25000 | 0 |
| 1.25 | 2300 | 10000 | slight |
| 1.25 | 8800 | 20000 | slight |
| 1.0 | 5200 | 12000 | 12 |
| 1.0 | 5400 | 13000 | 6 |
| 1.0 | 2000 | 8000 | 6 |

(1)Concentration of Gelwhite GP clay in final product
(2)Viscosity after completion of mixing
(3)Viscosity at thermodynamic low point after aging at room temp.
(4)Degree of separation of secondary phase in mm after 10 weeks at 38° C.

The foregoing tabulation clearly shows that the viscosity increases after manufacture and that the concentration of the clay has a greater effect on product ability against layering than does the viscosity of the final composition.

While the reasons for the increase in viscosity on aging or standing after manufacture are not understood, it is postulated that the clay particles establish more clay/clay interactions during standing so that a "house of cards" structure results. Eventually, all of the clay is believed to reach its thermodynamic low point where the viscosity levels off to a substantially constant value. When sheared as in dispensing from a squeeze bottle, the viscosity drops again to the lower value.

The peak viscosity in the inventive compositions also is influenced by the viscosity of the aqueous detergent mixture which in turn is dependent upon the individual surfactants and their concentrations. For example, the following Table B shows how the presence and concentration of the zwitterionic betaine surfactant affects the peak viscosity of a liquid detergent composition containing 17% by weight of sodium dodecylbenzene sulfonate (LDBS), 13% by weight of ammonium $C_{12}$–$C_{15}$ alkyl triethenoxy ether sulfate (AEOS) and 5.5% of ethanol.

TABLE B

| Formula | % Betaine (1)(by wt.) | Peak Visc. in cps. (stirred) |
|---|---|---|
| LDBS/AEOS | 0 | 4700 cps. |
| LDBS/AEOS | 2 | 7742 cps. |
| LABS/AEOS | 4 | 7845 cps. |

(1)Cocoamidopropyl dimethyl betaine
(2)Viscosity measured by Brookfield RVF Viscometer with a heliopath and a TA spindle rotating at 4 rpm.

As the betaine is amphoteric, it appears that it produces a cationic/anionic effect in the micelle which causes an increase in viscosity. This additional viscosity slows particle settling and collapse of the clay structure. These effects appear to be consistent with Stokes Law wherein the rate of settling is inversely proportional to the viscosity of the conttinuous phase.

Table C shows the effect on the viscosity of the surfactant concentrate by substituting other foam boosters for the betaine in the foregoing composition, namely, lauric myristic monoethanolamide (LMMEA) or $C_{10}$–$C_{14}$ alkyl dimethyl amine oxide (AO).

TABLE C

| Foam Booster and Concentration | Viscosity (cps)[1] after aging at 25° C. |
|---|---|
| 4% Betaine | 400 cps. |
| 4% LMMEA | 250 cps. |
| 4% AO | 250 cps. |

(1)Measured with a Brookfield RVF Viscometer using a Spindle rotating at 20 rpm.

It is noted also that formulas containing added $C_2$–$C_3$ alcohol reach higher viscosities faster than similar formulas without added alcohol. Since the ammonium $C_{12}$–$C_{15}$ alkyl triethenoxy ether sulfate is supplied as an aqueous alcoholic solution—contains 60% AEOS and about 14% ethanol—, the 17% LDBS/13% AEOS formulations contain about 3.25% ethanol. Another advantage of adding additional $C_2$–$C_3$ alcohol is that its presence assists in the deaeration of the liquid composition by thinning the surfactant solution before the addition of the clay premix which facilitates release of air.

While the reason for the increase and decrease of viscosity during mixing of the final product also is not understood, it is possible that this effect is due to clay/-surfactant interaction. Possibly, the peak viscosity is caused by a micellar attraction between clay particles that have been coated with surfactant. However, as the cationic portion of the clay particle becomes coated with anionic surfactant micelles, the clay surface becomes anionic and causes a net repulsion of other anionic particles, thereby resulting in a decrease in viscosity. Therefore, the subsequent decrease in viscosity may be due to repulsion between anionic clay particles.

In the process of making the inventive abrasive-containing liquid, dishwashing compositions, it is essential that a substantially fully swelled clay be prepared prior to its admixture with the surfactants. A fully swelled clay can be prepared by subjecting an aqueous mixture containing 4% to 18%, preferably 6% to 12%, by weight of clay to high shear mixing at a temperature of from 15° C. to 50° C. for up to about one hour or until a substantially constant viscosity is attained. Less time will be needed at the higher temperatures. Preferably a homogenizing mixer will be used in order to obtain a high shear rate and a low amount of aeration. Neither the mixing time nor the rate is critical so long as one skilled in the art recognizes that a high shear rate should be employed when the mixing time is less than one hour and a longer mixing time, e.g., up to four hours, should be used when a lower shear rate is employed.

Another step in the preparation of the inventive compositions is the preparation of an aqueous mixture containing at least one anionic sulfated or sulfonated detergent and the zwitterionic betaine or alkanoic acid $C_2$–$C_3$ alkanolamide or trialkyl amine oxide foam booster. In manufacturing the preferred composition, such step consists of forming an aqueous mixture of the sodium $C_8$–$C_{16}$ alkyl benzene sulfonate (ABS) or sodium $C_{10}$–$C_{20}$ alkene sulfonate (AS) and the $C_8$–$C_{16}$ alkyl polyethenoxy ether sulfate salt (AEOS) and, optionally, any added $C_2$–$C_3$ alcohol if present, it is important to control the alcohol concentration so that the flash point of the surfactant mixture and the final composition will be above about 45° C. Generally, the aqueous surfactant mixture will be a homogeneous liquid having a viscosity, in the range of 100 centipoises (cps) to 800 cps. preferably 200 cps. to 500 cps, using a Brookfield RVF Viscometer with a #1 spindle rotating at 20 rpm. Such aqueous surfactant mixture usually will contain from 17% to 70% preferably 28% to 62%, and most preferably 32% to 59% by weight of surfactants.

The next step in the process is the step of dispersing the particulate, water-insoluble abrasive in the aqueous surfactant mixture. This step is accomplished by adding said abrasive to the mixture. The step is accomplished by slowly adding said particulate abrasive to the surfactant mixture maintained at a temperature of 35° C. to 55° C., preferably 40° C.-50° C., with slow agitation and continuing such agitation until the resultant dispersion is free of entrapped air. Usually, this step takes about one hour, but the period of mixing is not critical and may be shortened to 30 minutes or increased to as much as two hours if conditions require.

The final step in the described process is the addition of the viscous, presheared clay/water mix to the dispersion of abrasive in the aqueous surfactants in the presence of agitation sufficient to disperse said clay without aeration of the mixture. Thereafter, agitation is continued while monitoring the viscosity of the resultant mixture. Mixing is continued until viscosity decreases to a substantially consistent minimum viscosity after first increasing to a maximum viscosity. The maximum and minimum viscosity values of the final product will vary primarily with the concentration of the clay, but the concentrations of the abrasive and of the surfactants also will affect the specific product viscosity values obtained. Typically, at a surfactant concentration of about 34% by weight, an abrasive concentration of 5% by weight and a clay concentration of 1.25% by weight, the maximum viscosity will be in the range of 2,000 cps. to 4,000 cps. and the constant minimum viscosity will be in the range of 1.000 cps. to 1,500 cps. On the other hand, when the concentrations of surfactants, abrasive and clay are decreased to 17%, 5% and 1.25% by weight, the maximum viscosity will range from 1,000 to 2,000 cps. and the constant minimum viscosity will be in the range from 600 to 1000 cps. (These viscosities are measured on a Brookfield HATD Viscometer using a No. 4 spindle rotaing at a 20 rpm—a high shear method.) During this step, the temperature is maintained in the range of about 38° C. to 50° C. and the mixing period may range from about thirty minutes to about 4 hours, preferably from about forty-five minutes to about two hours.

When agitation ceases, the viscosity of the product increases by a factor in the range of 1.5 to 4 depending primarily on the concentration of the clay. However, the final product exhibits satisfactory stability and is both easy to dispense and disperse if the viscosity is in the range of 600 cps. to 5,000 cps. preferably 1,000 cps. to 3,000 cps. as measured by a Br okfield HATD Viscometer with the No. 4. spindle rotating at 20 rpm. After aging at room temperature for about twenty-four hours, product exhibits a flow rate in the range of one to two grams/sec. at 22° C. when tested by measuring the flow rate through an opening having a diameter of 3 mm. from a bottomless container containing 700 grams of product. Despite the increase in viscosity, all products flow and any agitation such as shaking the container readily increases the flow rate.

The following examples are merely illustrative of the invention and are not to be construed as limiting thereof. All percentages in the examples and elsewhere in the specification are by weight unless otherwise specified.

EXAMPLE 1

A highly preferred abrasive-containing, liquid, dishwashing detergent composition containing a zwitterionic betaine as the foam improving ingredient has the following formula and is prepared in the manner described.

| Ingredient | % by weight |
|---|---|
| Part I | |
| Softened Water | 92 |
| Clay (Gel white GP) | 8.0 |
| | 100.0 |
| Part II | |
| Ammonium $C_{12}$-$C_{15}$ alkyl triethenoxy ether sulfate solution(2) | 21.7 |
| Ethanol (92.5% anhydrous) | 2.5 |
| Sodium $C_{10}$-$C_{13}$ linear alkylbenzene sulfonate slurry(3) | 30.6 |
| Cocoamidopropyl dimethyl betaine solution(4) | 13.3 |
| Calcined diatomaceous earth(1) | 5.0 |
| Water | 10.7 |
| Part I (8% clay dispersion) | 15.6 |
| Perfume | 0.5 |
| Color solution | q.s. |
| | 100.0 |

(1)Calcined diatomaceous earth purchased from Johns Manville as Celite 560 having the following particle size distribution: +595μ = .01%; −595u, +250μ = 5.4%; −250μ, +74μ = 16%; −74μ, +44μ = 14.8%; and −44μ = 63.8%.
(2)Contains, by weight, 60% of said alkyl sulfate salt, 14% ethanol and 26% water.
(3)Contains, by weight, 56% of sulfonate salt, 1.5% maximum of sodium sulfate. 2.5% of sodium xylene sulfonate and 39% water.
(4)Contains, by weight, 30% of betaine, 5% maximum of sodium chloride. 2-3% glycerine and 63% water.

The clay dispersion—Part 1—is prepared by mixing the clay and water at high speed using an Eppenbach Homo mixer for about 1 hour at 7,000 rpm which results in a thick uniform dispersion that becomes solid on standing, but reliquefies upon agitation. Agitation speeds of 1,000 to 8,000 rpm may be employed provided that the time of mixing is adjusted to correspond to the speed. Lower speeds require a longer mixing period; whereas higher speeds enable use of a shorter mixing period.

In preparation of Part 2, the ammonium $C_{12}$-$C_{15}$ alkyl triethenoxy ether sulfate (AEOS) solution is mixed with the added ethanol prior to the addition of sodium alkylbenzene sulfonate (SABS) slurry and the betaine solution. The balance of the formula amount of water is added to the aqueous surfactant mixture having a temperature of about 50° C. with moderate agitation in order to from a substantially deaerated, homogeneous, translucent mixture. Next, the diatomaceous earth abrasive is dispersed in the aqueous surfactant solution with very slow agitation, which agitation is continued until the diatomaceous earth is completely wetted. Trapped air is released visibly from said mixture in the form of foam when the agitation is slowed or stopped and agitation is continued until the dispersion is substantially deaerated. At this point, Part I is added. Then, the speed of agitation is increased to a speed of 500 rpm to form a dispersion of the wetted clay in the surfactant mixture.

After the addition of Part I, agitation is controlled to eliminate a vortex which would cause aeration and ultimate separation of the final product. As the agitation continues, an increase in viscosity to a maximum of about 8,000–9,000 cps. is noted followed by a decrease to a relatively constant viscosity of about 2500 cps. after about 2 to 5 hours of agitation. (Viscosity is determined using a Brookfield Heliopath RVF viscometer with a TA spindle rotating at 4 rpm) During the mixing period, the perfume and color solution are added and the pH of the product is adjusted to 7.3±0.4 using aqueous sulfuric acid and/or aqueous sodium hydroxide. The specific gravity of the resultant product is in the range of 1.065 to 1.075.

When sodium $C_{13}$–$C_{17}$ alkane sulfonate is substituted for SABS in the foregoing composition, an equivalent preferred composition of good physical stability is achieved.

EXAMPLE 2

The composition of Example 1 is repeated using the process described in that Example with the exception that 4% by weight of lauric-myristic monoethanolamide and 9.3% by weight of water are substituted for the 13.3% by weight of said betaine solution. In the process of making this composition the peak viscosity attained after the addition of clay dispersion is 7040 cps. and this viscosity decreases to 3200 centipoises after about 3 hours of agitation. The viscosity further decreases to 2880 cps. after 24 hours of aging at room temperature. Product pH is 7.3+0.3.

EXAMPLE 3

Using the same process described in Example 1, the composition of that Example is repeated with the exception that 13.3% by weight of lauryl dimethyl amine oxide solution purchased under the tradename Ammonyx LO is substituted for the 13.3% by weight of said betaine solution. (Ammonyx LO contains 30% by weight of lauryldimethyl amine oxide, 0.5% by weight of free amine, 1% free fatty acid and 68.5% by weight of water.) After addition of the clay dispersion, the viscosity increases to a maximum of 5600 cps. after about one hour of agitation and thereafter decreases to a relatively constant minimum of 5060 cps. after another thirty minutes of agitation. As with Example 11, the viscosity decreases to 3150 cps. after a further twenty-four hours of standing at 24° C.

The improved stability against separation which is provided by the inventive process is apparent from a consideration of the results set forth in Table D wherein the compositions of Examples 1–3 are compared with the leading commercial product—Cinch® manufactured by Procter & Gamble Company. More particularly, Table D sets forth the percent of separation noted after centrifuging samples of the various products at 1000 times the force of gravity for one, two and three hours,

TABLE D

| Product | % Separation* | | |
|---|---|---|---|
| | 1 hr. | 2 hr. | 3 hr. |
| Example 1 | 0 | 13 | 26 |
| Example 2 | 0 | 12.8 | 25.6 |
| Example 3 | 12.5 | 31.3 | 37.5 |
| Commercial Product | 14.4 | 40.3 | 43.5 |

*Volume percentage of clear liquid layer on the top of the sample.

Clearly, these results show that the inventive process produces a product with improved stability as compared with the leading commercial product. Furthermore, while the results show that improved stability is achieved with formulations containing betaine, alkanolamide and amine oxide foam boosters are present.

Table E below shows that the stability results based upon the centrifuge test correlate well with the stability results obtained when samples are aged at room temperature—24° C.—and at 39° C.

TABLE E

| Product | % Separation* | |
|---|---|---|
| | 24° C.(1) | 38° C.(2) |
| Example 1 | 0 | 0.09 |
| Example 2 | 0 | 0.08 |
| Example 3 | — | 1.0 |
| Commercial Product | 0.1 | 0.68 |

*Weight percent of clear liquid layer on top of the sample.
(1)Three weeks aging
(2)One month aging In addition, Table F shows that the improvement in stability is achieved while maintaining viscosity and flow rate comparable to the leading commercial product.

TABLE F

| Product | Viscosity(1)cps. | Flow Rate(2) |
|---|---|---|
| Example 1 | 3040 | 1.28 |
| Example 2 | 1608 | — |
| Example 3 | 1944 | — |
| Commercial Product | 2340 | 0.72 |

(1)Brookfield HATD Viscometer, #4 spindle @ 50 rpm
(2)Grams persecond through a 3mm. diameter opening from a 22 ounce bottle with the bottom removed so that only the weight of the product causes flow.

Additional satisfactory compositions made in the manner set forth in Example 1, but containing additional ethanol, have the compositions set forth in Examples 4 and 5 below.

EXAMPLES 4 AND 5

EXAMPLES 4 AND 5

| Ingredient | % by weight | |
|---|---|---|
| | Ex. 4 | Ex. 5 |
| Sodium linear dodecylbenzene sulfonate | 17 | 17 |
| Ammonium $C_{12}$–$C_{15}$ alkyl triethenoxy ether sulfate | 13 | 17 |
| Cocoamidopropyl dimethyl betaine | 4 | 4 |
| Gelwhite GP clay | 1.25 | 1.25 |
| Calcined Diatomaceous earth (Celite 560) | 5 | 5 |
| Ethanol | 5.75 | 8.25 |
| Water, salts, color, perfume | q.s | q.s |
| | 100.0 | 100.0 |

The foregoing compositions exhibit good foaming and soil removal properties in dishwashing tests and also are stable against separation at room temperature—24° C.

Example 6 describes another satisfactory composition prepared by the inventive method.

EXAMPLE 6

| EXAMPLE 6 | |
|---|---|
| Ingredient | % by weight |
| Sodium linear dodecylbenzene sulfonate | 8.5 |
| Ammonium $C_{12}$-$C_{15}$ alkyl triethenoxyether sulfate | 6.5 |
| Cocoamidopropyl dimethyl betaine | 2 |
| Gelwhite GP clay | 1.5 |
| Calcined diatomaceous earth (Celite 560) | 5.0 |
| Ethanol | 4.0 |
| Water, salts, color, perfume | q.s. |
| | 100.0 |

The peak viscosity attained is 1000 cps. and this viscosity is noted after three hours of agitation at 500 rpm with a turbine agitator. However, unlike prior compositions, no decrease in viscosity is noted after an additional hour of mixing. After 24 hours of standing at 24° C., a viscosity of 1300 cps. is obtained. (Viscosity is measured with a brookfield HATD Viscometer using a TA spindle at 5 rpm).

Table G sets forth the percent of separation noted after centrifuging the composition of Example 6 at 1000 times the force of gravity for 30, 60, 90 and 120 minutes. A sample of the leading commercial product is included for comparison:

TABLE G

| | % Separation* | | | |
|---|---|---|---|---|
| | 30 min. | 60 min. | 90 min. | 120 min. |
| Example 6 | 0 | 0 | 0 | 0 |
| Commercial Product | 7.9 | 15.8 | 27.6 | 28.9 |

*Volume percentage of clear liquidlayeron top of the sample

EXAMPLE 7

Another preferred composition prepared by the inventive method of Example 1 has the following composition:

| Ingredient | % by weight |
|---|---|
| Sodium $C_{10}$-$C_{15}$ linear alkyl benzene sulfonate(1) | 16.3 |
| Sodium $C_{12}$-$C_{14}$ alkyl triethenoxy ether sulfate | 12.5 |
| Coconut fatty acid ($C_8$-$C_{18}$) diethanolamide | 3.8 |
| Ethanol | 6.3 |
| Calcined diatomaceous earth (Celite 560) | 4.8 |
| Gelwhite (GP) clay(2) | 1.2 |
| Water, salts, color, perfume | q.s. |
| | 100.0 |

(1)Aided in the form of 44.4% by weight of an aqueous mixture containing 28.3% sodium dodecylbenzene sulfonate and 28.2% sodium $C_{12}$-$C_{14}$ alkyl triethenoxy ether sulfate, 7% sodium sulfate and 36.5% water with 7.7% by weight of an aqueous mixture containing 54.2% by weight of sodium dodecylbenzene sulfonate, 1.2% by weight of sodium sulfate, 1.1% unsulfonated and 43.5% water.

(2)Added as an aqueous dispersion containing 8% by weight of clay. In the process of making the composition of Example 7, the peak viscosity attained after the addition of clay dispersion is 3330 cps., where viscosity is noted after about one hour of mixing at 500 rpm. This viscosity decreases to 2964 cps. after about two hours of agitation. After about twenty four hours of standing at 24° C., the viscosity is 2600 cps. (All of the foregoing viscosities are measured using a Brookfield LVF Viscometer with a TA spindle rotating at 10 rpm.)

(1) Aided in the form of 44.4% by weight of an aqueous mixture containing 28.3% sodium dodecylbenzene sulfonate and 28.2% sodium $C_{12}$-$C_{14}$ alkyl triethenoxy ether sulfate, 7% sodium sulfate and 36.5% water with 7.7% by weight of an aqueous mixture containing 54.2% by weight of sodium dodecylbenzene sulfonate, 1.2% by weight of sodium sulfate, 1.1% unsulfonated and 43.5% water.

(2) Added as an aqueous dispersion containing 8% by weight of clay.

In the process of making the composition of Example 7, the peak viscosity attained after the addition of claim dispersion is 3330 cps., where viscosity is noted after about one hour of mixing at 500 rpm. This viscosity decreases to 2964 cps. after about two hours of agitatiion. After about twenty four hours of standing at 24° C., the viscosity is 2600 cps. (All of the foregoing viscosities are measured using a Brookfield LVF Viscometer with a TA spindle rotating at 10 rpm.)

Varations in the above formulations may be made. For example, other alkyl benzene sulfonates may be substituted for the sodium linear dodecylbenzene sulfonate such as potassium $C_{10}$-$C_{13}$ alkyl benzene sulfonate, ammonium, sodium or potassium myristyl benzene sulfonate, and the like. Similarly, other alkyl ethenoxy ether sulfates may be substituted for the ammonium $C_{12}$-$C_{15}$ alkyl triethenoxy ether sulfate such as sodium and potassium $C_{12}$-$C_{15}$ alkyl polyethenoxy (1-12 EO) ether sulfates and the like. Likewise, other betaines may be substituted for the cocoamidopropyl betaine such as cocoamidoethylbetaine, cocodimethyl betaine and the like.

In addition, the amounts of each of the anionic detergents, the betaine, the clay and the abrasive may be varied within the stated ranges provided that the product performance stability and dispersibility are maintained.

It should be recognized that the described compositions are non-Newtonian, thixotropic fluids and the viscosity of non-Newtonian, thixotropic fluids is dependent upon the shear rate. Therefore, several shear rates must be employed to accurately characterize the physical characteristics of a given formula. In the foregoing description, viscosity is measured both at a relatively low shear rate and at a relatively high shear rate. For example, when the Brookfield RVF viscometer is operated with a heliopath TA spindle at 4 rpm, a relatively low shear rate results; whereas, when a Brookfield HATD viscometer is operated with the #4 spindle at 20 rpm, a relatively high shear rate is attained.

The invention has been described with repsect to various examples and embodiments but is not to be limited to these because it is evident that one of skill in the art with the present application before him will be able to utilize substitutes and equivalents without departing from the spirit of the invention.

What is claimed is:

1. A process of making a light duty liquid detergent composition containing an abrasive which comprises the steps of (1) preparing a substantially fully hydrated aqueous clay suspension by shearing a thixotropic clay-water mixture containing 4% to 18% by weight of a colloidal clay until a subtantially constant viscosity is reached; (2) preparing an aqueous surfactant concentrate containing from 17% to 70% by weight of a mixture of at least one anionic sulfated or sulfonated detergent and a foam boosting ingredient selected from the group consisting of a zwitterionic betaine surfactant, a trialkyl amine oxide detergent containing a $C_{10}$-$C_{16}$ alkyl group and a $C_8$-$C_{18}$ alkanoic acid $C_2$-$C_3$ alkanolamide; (3) dispersing a porous, low-density, particulate abrasive selected from the group of calcined diatomaceous earth and particulate polymeric plastic materials having a specific gravity of from 0.75 to 1.5 in said aqueous detergent mixture with sufficient agitation to disperse the particles and release entrapped air; (4) continuing said agitation until a substantially deaerated dispersion is obtained; (5) adding the substantially fully hydrated clay suspension of step 1 to the deaerated dispersion of step 4 with agitation at a speed sufficient to disperse said suspension without aeration of the mixture; and (6) continuing said agitation while monitoring the viscosity until a substantially constant minimum viscosity is obtained after an initial increases to a viscosity maximum, whereby a stable detergent composition is produced consisting essentially of, by weight, 10% of 50% of a mixture of anionic detergent and said foam booster 1% to 3% of said clay, 3% to 15% of said abrasive and the balance water.

2. A process according to claim 1 wherein said aqueous surfactant concentrate contains a $C_2$–$C_3$ alcohol in an amount sufficient to provide a detergent composition containing from 2% to 9% by weight of said alcohol.

3. A process according to claim 2 wherein said abrasive is said calcine diatomaceous earth having a particle size range, by weight, in which about 20% to 45% of the particles are larger than 44 microns, with a minimum of 5% to 15% of particles being larger than 149 microns.

4. A process according to claim 3 wherein said betaine is the foam boosting ingredient.

5. A process according to claim 3 wherein said alkanoic acid alkanolamide is the foam boosting ingredient.

6. A process according to claim 4 wherein said aqueous surfactant concentrate contains a mixture of a water-soluble salt of a $C_9$–$C_{15}$ alkylbenzene sulfonate and a water-soluble salt of a $C_8$–$c_{16}$ alkyl polyethenoxy ether sulfate having 1 to 12 ethenoxy groups in the molecule and the concentration of surfactant in said concentrate is from about 28% to about 62% by weight.

7. A process according to claim 5 wherein the said aqueous surfactant concentrate contains a mixture of a water-soluble salt of a $C_{10}$–$C_{20}$ alkane sulfonate and a water-soluble salt of a $C_8$–$C_{16}$ alkyl polyethenoxy ether sulfate having 1 to 12 ethenoxy groups and the concentration of surfactant in said concentrate is from about 28% to about 62% by weight.

8. A process according to claim 6 wherein said clay dispersion contains 6% to 12% by weight of said clay and said surfactant concentrate contains about 32% to 59% by weight of surfactants.

9. A light duty liquid detergent composition containing an abrasive which consists essentially of, by weight, 3% to 15% of a particulate, low density abrasive selected from the group consisting of calcined diatomaceous earth and polymeric plastic materials having a specific gravity of 0.75 to 1.5 suspended in an aqueous mixture containing 8% to 48% of at least one water-soluble, detergent salt selected from the group consisting of an anionic sulfate or aionic sulfonate or mixtures thereof containing an alkyl group or an alkenyl group having from 8 to 20 carbon atoms in the molecule, 2% to 5% of a foam boosting zwitterionic betaine detergent which increases the viscosity of the continuous phase having the formula:

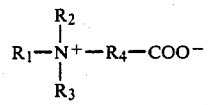

wherein $R_1$ is an alkyl group having 10 to 20 carbon atoms or the amido radical $R—C(O)N(H)(CH_2)_a—$ wherein RCO is an acyl group having about 10 to 20 carbon atoms and a is an integer from 1 to 4, $R_2$ and $R_3$ are each alkyl groups having 1 to 3 carbon atoms, 1% to 3% of a substantially fully hydrated aqueous clay suspension prepared by shearing a thioxotropic clay-water mixture until a substantially constant viscosity is reached, and the balance water wherein said liquid detergent is agitated while monitoring the viscosity until a substantially constant minium viscosity is obtained after an initial increase to a viscosity maximum, whereby a stable detergent composition is produced.

10. A composition according to claim 9 wherein sasid anionic sulfonate or sulfate detergent is a mixture of a water-soluble $C_9$–$C_{15}$ alkylbenzene sulfonate salt or a water-soluble $C_{10}$–$C_{20}$ alkane sulfonate salt and a water-soluble $C_8$–$C_{16}$ akyl polythenoxy ether sulfate salt having 1 to 12 ethenoxy groups in the molecule, the weight ratio of said sulfonate salt to said sulfate salt being in the range of 10:1 to 1:4.

11. A composition according to claim 10 wherein said anionic detergent is a mixture of said alkylbenzene sulfonate salt and said alkyl polyethenoxy ether sulfate salt, said abrasive is said calcined diatomaceous earth and the balance of said composition is a mixture of water and said $C_2$–$C_3$ alcohol, said alcohol being present in an amount of 2% to 9% by weight of the composition.

12. A composition according to claim 11 wherein said anionic detergent mixture is present in an amount of 18% to 38% by weight of the composition.

13. A composition according to claim 10 wherein said anionic detergent is a mixture of said alkane sulfonate salt and said alkyl polyethenoxy ether sulfate salt, said abrasive is said calcined diatomaceous earth and the balance of said composition is a mixture of water and $C_2$–$C_3$ alkanol, said alcohol being present in an amount of 2% to 9% by weight of the composition.

14. A composition according to claim 13 wherein said anionic detergent mixture is present in an amount of 18% to 38% by weight of the composition.

15. A composition according to claim 11 wherein said anionic detergent mixture is present in an amount of 23% to 33% by weight of the composition and the proportion of total surfactants is 25% to 35% by weight of the composition.

* * * * *